US010730733B2

(12) United States Patent
Harlow

(10) Patent No.: US 10,730,733 B2
(45) Date of Patent: Aug. 4, 2020

(54) METHOD AND APPARATUS FOR PUNCTURING A CONTAINER

(71) Applicant: Daniel W. Harlow, Virginia Beach, VA (US)

(72) Inventor: Daniel W. Harlow, Virginia Beach, VA (US)

( * ) Notice: Subject to any disclaimer, the term of this patent is extended or adjusted under 35 U.S.C. 154(b) by 34 days.

(21) Appl. No.: 15/962,759

(22) Filed: Apr. 25, 2018

(65) Prior Publication Data

US 2018/0334370 A1 Nov. 22, 2018

Related U.S. Application Data

(60) Provisional application No. 62/507,666, filed on May 17, 2017.

(51) Int. Cl.
*B67B 7/00* (2006.01)

(52) U.S. Cl.
CPC ..... *B67B 7/24* (2013.01)

(58) Field of Classification Search
CPC ..... B67B 7/24; B67B 7/28; B67B 7/26
USPC ..... 30/443
See application file for complete search history.

(56) References Cited

U.S. PATENT DOCUMENTS 133,500 A * 11/1872 Thomas ..... B67B 7/24 30/447
1,366,714 A * 1/1921 Burkert ..... A47G 19/12 222/83.5
1,911,506 A * 5/1933 Higgins ..... B67B 7/24 30/446
2,190,275 A * 2/1940 Simunich ..... B67B 7/24 30/446
2,338,592 A * 1/1944 Lorenzen ..... B67B 7/24 30/443
2,603,385 A * 7/1952 Toth ..... B67B 7/28 222/83.5
2,686,964 A * 8/1954 Manthey ..... B67B 7/24 30/446
3,678,578 A * 7/1972 Patton, Jr. ..... B67B 7/24 30/448
4,136,448 A * 1/1979 Fournier ..... B67B 7/24 30/407
4,620,576 A * 11/1986 Owen, Jr. ..... B67B 7/28 141/1
4,684,038 A * 8/1987 Gaul ..... B67B 7/28 222/89
4,775,012 A * 10/1988 Thompson ..... A62C 13/00 169/71
7,096,759 B2 * 8/2006 Kirko ..... B67B 7/40 81/3.47

(Continued)

FOREIGN PATENT DOCUMENTS

CN 203203847 U * 9/2013
WO WO-0035802 A1 * 6/2000 ..... B65G 65/23

*Primary Examiner* — Jennifer B Swinney
(74) *Attorney, Agent, or Firm* — Ellenoff Grossman & Schole LLP; James M. Smedley; Alex Korona

(57) ABSTRACT

An apparatus is disclosed. The apparatus has a body member including a beverage-container-receiving cavity, an aperture disposed on the body member, and a movable member disposed on the body member, the movable member having a beverage-container-puncturing portion. The beverage-container-puncturing portion is selectively movable into the beverage-container-receiving cavity via the aperture.

18 Claims, 6 Drawing Sheets

(56) References Cited

U.S. PATENT DOCUMENTS

| | | | | |
|---|---|---|---|---|
| 2005/0139605 | A1* | 6/2005 | Benktzon | B65D 83/0463 221/25 |
| 2014/0237952 | A1* | 8/2014 | Fesler | B67B 7/16 53/492 |

* cited by examiner

METHOD AND APPARATUS FOR PUNCTURING A CONTAINER

RELATED APPLICATIONS

This application claims the benefit of U.S. Provisional Patent Application Ser. No. 62/507,666 filed May 17, 2017, which is hereby incorporated by reference in its entirety.

TECHNICAL FIELD

The present disclosure generally relates to a method and apparatus for puncturing, and more particularly to a method and apparatus for puncturing a container.

BACKGROUND

Containers are structures that retain matter, with some containers being variously adapted to retain different types of matter. For example, some containers may be adapted to retain liquid matter such as in the case of a beverage container. Many containers provide an opening to facilitate pouring or consumption of a beverage retained within the container.

The opening provided by some containers may not be large enough to facilitate rapid pouring or consumption. In some scenarios, retained liquids may egress slowly from a container. Such slow liquid egress from a container may be a result of a pressure differential between the space inside the container and outside the container, as liquid is removed from a single container opening. In some scenarios, providing some containers with a second opening may speed the egress of liquid from the container to facilitate more rapid pouring or consumption.

Puncturing a second opening in some containers may involve a user using two hands to handle a container. For example, puncturing a second opening may involve a user using one hand to hold the container, and another hand to operate a puncturing tool. Puncturing an opening in a container to facilitate more rapid liquid egress using two hands may be time consuming, inconvenient, and potentially dangerous. In some scenarios, the time required to puncture a container opening using two hands may limit a consumer's optimum beverage consumption rate. Puncturing an opening in a container using two hands may prevent a consumer from manipulating a remote control or consuming food with one hand. In some scenarios, a container opening punctured by a tool retained in a consumer's hand may have hazardous sharp edges. Such hazardous sharp edges may be a result of inconsistent tool placement or action by the consumer on the container surface.

Conventional approaches to opening containers include keychains that have sharp points on them to provide an opening in a beer can to shotgun the beer, which in many scenarios may be difficult or dangerous to use. For example, providing an opening in a beer can with a sharp point on a keychain may involve the use of two hands by a user, making simultaneous operation of other devices, such as a remote control, more difficult. In some scenarios, opening a hole in a beer can with a sharp object held in one hand, while holding the beer can in the other hand, may raise the risk of injury during the opening operation. For example, creating an opening in a beer can with a sharp object held in one hand may result in a jagged, irregular opening with sharp edges presenting a cutting injury hazard to a consumer who may attempt to shotgun the opened container.

The exemplary disclosed system and method are directed to overcoming one or more of the shortcomings set forth above and/or other deficiencies in existing technology.

SUMMARY OF THE DISCLOSURE

In one exemplary aspect, the present disclosure is directed to an apparatus. The apparatus includes a body member including a beverage-container-receiving cavity, an aperture disposed on the body member, and a movable member disposed on the body member, the movable member having a beverage-container-puncturing portion. The beverage-container-puncturing portion is selectively movable into the beverage-container-receiving cavity via the aperture.

In another aspect, the present disclosure is directed to method. The method includes providing an assembly having a cavity and a movable member that is disposed on the assembly, and removably disposing a beverage container in the cavity. The method also includes moving the movable member through an aperture of the assembly and into the cavity, and puncturing the beverage container with the movable member.

DETAILED DESCRIPTION AND INDUSTRIAL APPLICABILITY

Figure 1:
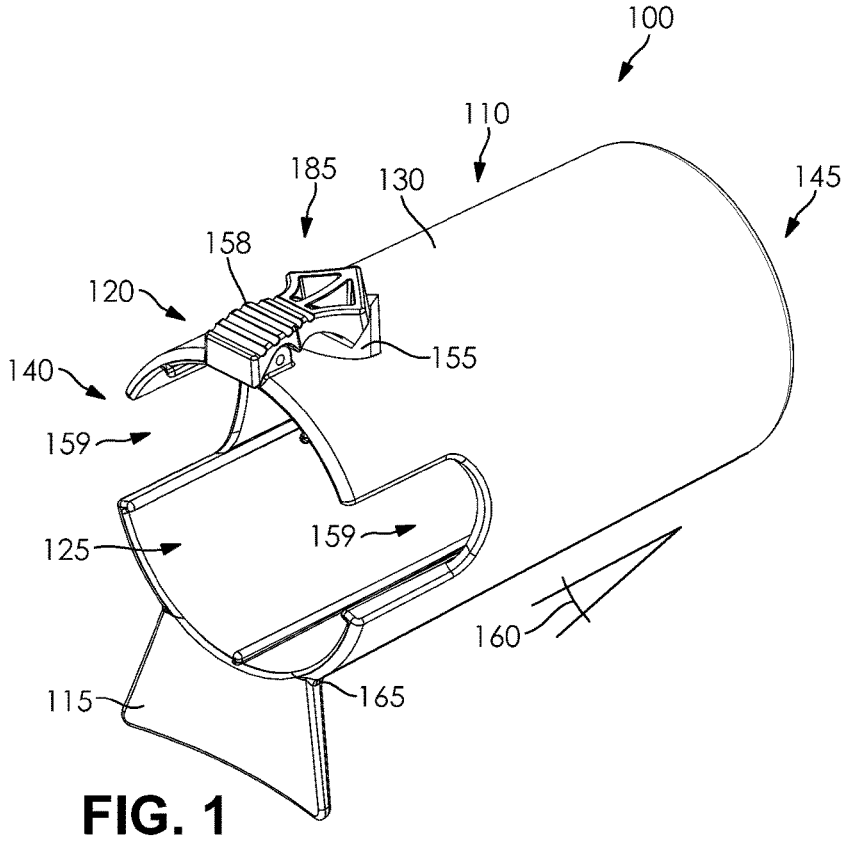
FIG. 1 depicts a side perspective view of an exemplary apparatus of the present invention.
Figure 2:
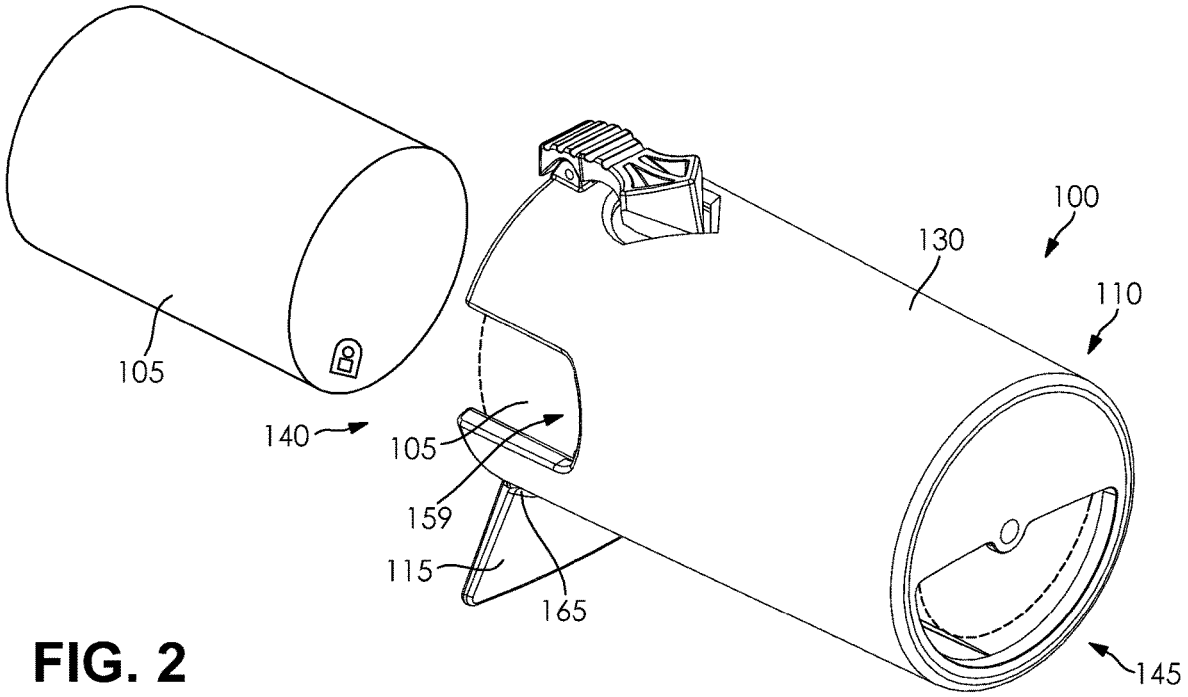
FIG. 2 depicts a side perspective view of an exemplary apparatus of the present invention.

FIGS. 1 and 2 illustrate an exemplary assembly 100 for puncturing an object. Assembly 100 may be used for example to puncture a container 105. For example, assembly 100 may be used in any application for opening container 105 to increase and/or enhance a flow rate of material from container 105.

Container 105 may be any suitable type of container that may be punctured and that may hold any desired type of material. For example, container 105 may be a can such as, e.g., a metal can. For example, container 105 may be an aluminum can, a tin can, a tin-plated steel can, a coated metallic can, a metal alloy can, a plastic can, a can formed from a combination of material, and/or a container formed from any suitable material that may be punctured. For example, container 105 may be formed from any suitable material that may be punctured without shattering, collapsing, and/or otherwise losing structural stability. Container 105 may for example be a sealed container that may be punctured by assembly 100. Container 105 may also include an opening device that may allow a user to open container 105 such as, for example, a tab such as a stay-tab or a pull-tab, a threaded cap, a cork, a pop-tab, a press-button, a resealable lid, and/or any other suitable opening device.

Container 105 may be configured to hold any desired material. For example, container 105 may hold fluid material such as a liquid fluid (e.g., liquid) and/or a gaseous fluid and/or solid material (e.g., such as fine material such as powder and/or any other suitable solid that may flow out of a container). For example, container 105 may hold a liquid such as a liquid beverage. For example, container 105 may hold an alcoholic beverage such as beer, a carbonated beverage, and/or any other beverage that may be consumed by a user.

As illustrated in FIGS. 1 and 2, assembly 100 may include a body member 110, a base member 115, and a movable member 120. Base member 115 and movable member 120 may be disposed on body member 110.

As illustrated in FIGS. 1-4, body member 110 may be any suitable member for removably receiving container 105. For example, body member 110 may include a cavity 125 that may removably receive container 105. For example, body member 110 may have a substantially cylindrical structure or a partially cylindrical structure. For example, body member 110 may have a cylindrical portion 130 and/or a wedge portion as disclosed below. For example, cylindrical portion 130 may have a semi-circular and/or elliptical shape. For example, cylindrical portion 130 may provide a substantially semi-circular top half section of body member 110. Also for example, a wedge portion (e.g., as disclosed below) may provide a bottom half (e.g., or upper half and/or any other suitable portion) of body member 110 including a plurality of substantially linear or non-linear sections (e.g., two, three, four and/or any other suitable greater number of linear or non-linear sections). For example, a configuration of cylindrical portion 130 and/or an exemplary wedge portion (e.g., as disclosed below) may provide a wedge-like retention capability to secure container 105 during puncturing (e.g., during puncturing by movable member 120). Also for example, body member 110 may include linear sections formed to securely retain (e.g., securely removably retain) container 105. Further for example, surfaces of cavity 125 may be sloped so that, e.g., dimensions of cavity 125 decrease slightly (e.g., and/or significantly) moving in a direction from end portion 140 toward end portion 145. Additionally for example, portion 130 may be of any desired shape, configuration, and/or size.

For example as illustrated in FIG. 1, cavity 125 may be open at end portion 140. For example, body member 110 may be closed at an end portion 145 that is distal from end portion 140 that may be open. Also for example, body member 110 may be open at both end portion 140 and end portion 145. Further for example, body member 110 may include a protrusion 150 (e.g., a ridge or a shelf) that may be concentric with and smaller in diameter than an inner surface diameter of end portion 140 that may be open. Protrusion 150 may substantially prevent container 105 from passing through end portion 145 (e.g., when end portion 145 is open).

Body member 110 (e.g., as well as base member 115, movable member 120, and/or any other suitable component of assembly 100) may be formed from any suitable materials for retaining and/or puncturing container 105 such as, for example, polymer material, structural metal (e.g., structural steel), co-polymer material, thermoplastic and thermosetting polymers, resin-containing material, polyethylene, polystyrene, polypropylene, epoxy resins, phenolic resins, Acrylanitrile Butadiene Styrene (ABS), Polycarbonate (PC), Mix of ABS and PC, Acetal (POM), Acetate, Acrylic (PMMA), Liquid Crystal Polymer (LCP), Mylar, Polyamid-Nylon, Polyamid-Nylon 6, Polyamid-Nylon 11, Polybutylene Terephthalate (PBT), Polycarbonate (PC), Polyetherimide (PEI), Polyethylene (PE), Low Density PE (LDPE), High Density PE (HDPE), Ultra High Molecular Weight PE (UHMW PE), Polyethylene Terephthalate (PET), PolPolypropylene (PP), Polyphthalamide (PPA), Polyphenylenesulfide (PPS), Polystyrene (PS), High Impact Polystyrene (HIPS), Polysulfone (PSU), Polyurethane (PU), Polyvinyl Chloride (PVC), Chlorinated Polyvinyl chloride (CPVC), Polyvinylidenefluoride (PVDF), Styrene Acrylonitrile (SAN), Teflon TFE, Thermoplastic Elastomer (TPE), Thermoplastic Polyurethane (TPU), and/or Engineered Thermoplastic Polyurethane (ETPU), or any suitable combination thereof.

Figure 3:
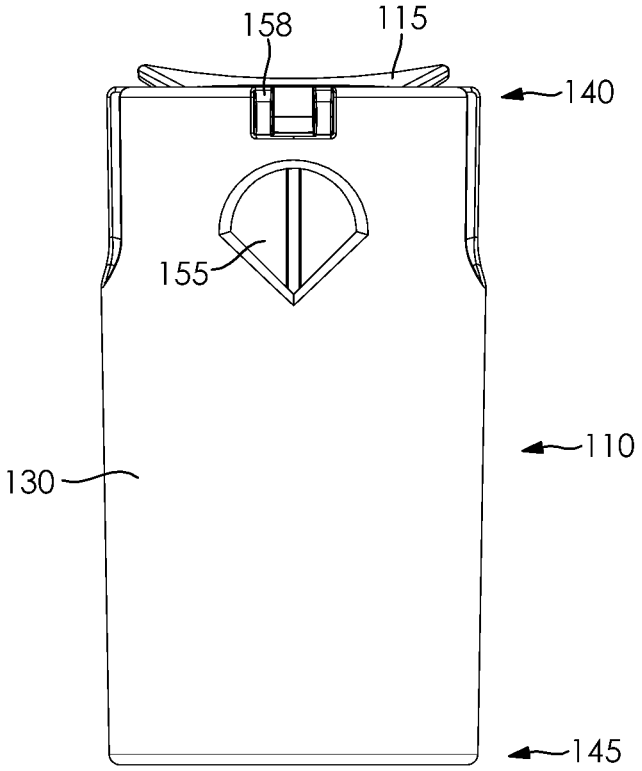
FIG. 3 depicts a top view of an exemplary apparatus of the present invention.
Figure 4:
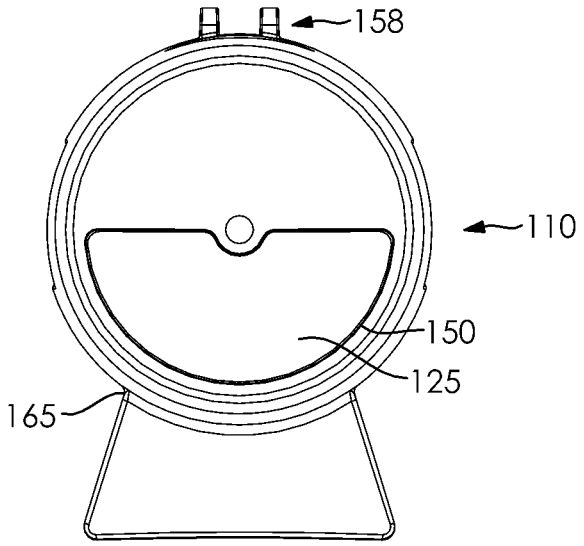
FIG. 4 depicts a rear view of an exemplary apparatus of the present invention.
Figure 5:
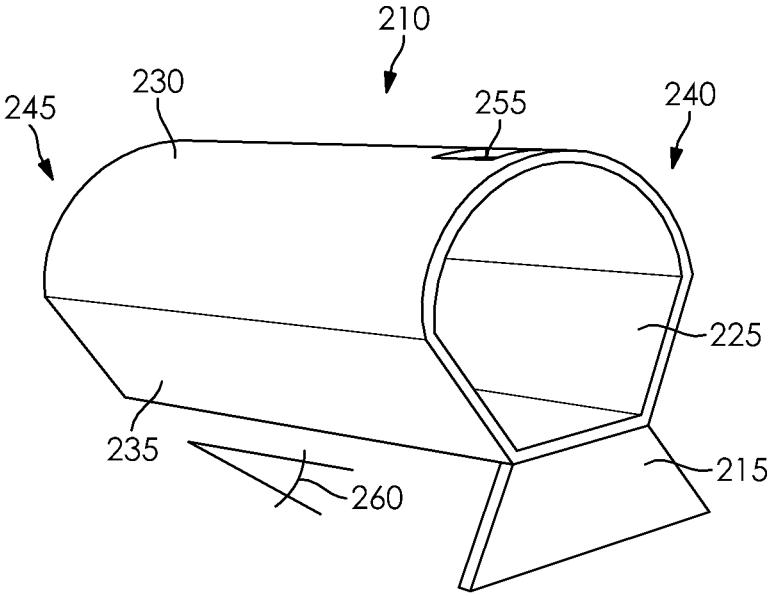
FIG. 5 depicts a side perspective view of an exemplary apparatus of the present invention.
Figure 6:
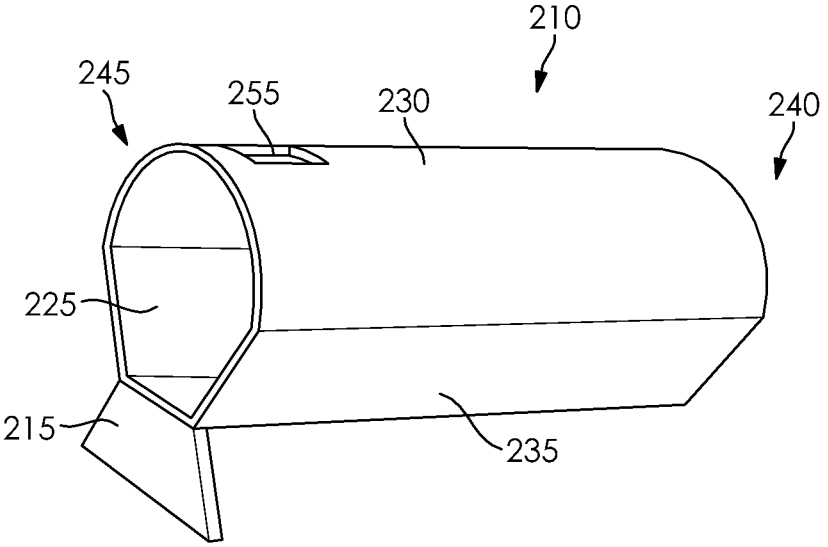
FIG. 6 depicts a side perspective view of an exemplary apparatus of the present invention.
Figure 7:
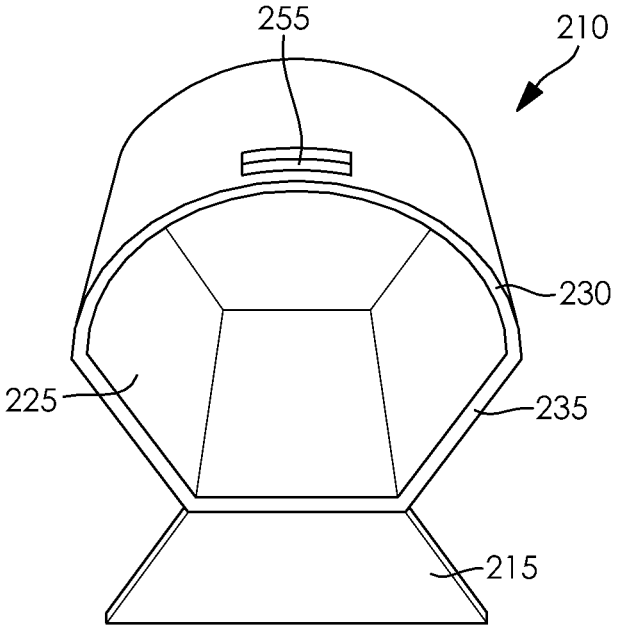
FIG. 7 depicts a front perspective view of an exemplary apparatus of the present invention.
Figure 8:
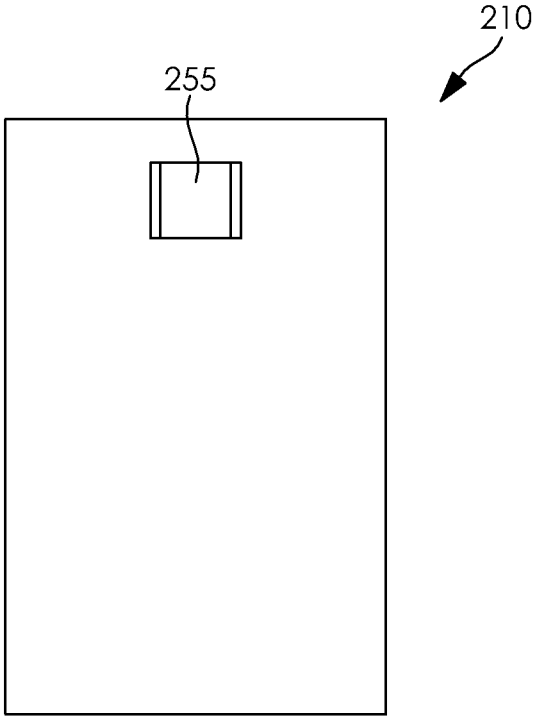
FIG. 8 depicts a top view of an exemplary apparatus of the present invention
Figure 9:
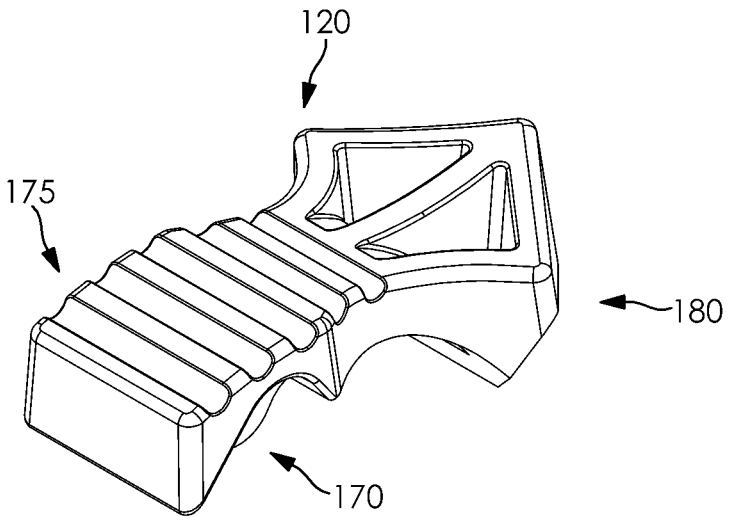
FIG. 9 depicts a side perspective view of a portion of an exemplary apparatus of the present invention.
Figure 10:
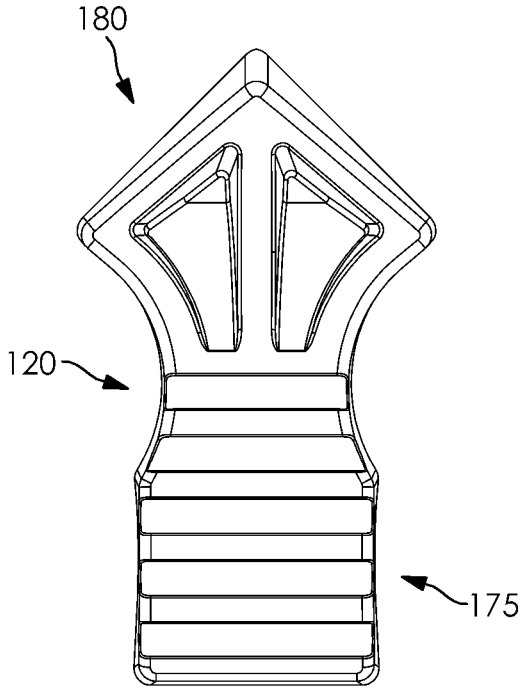
FIG. 10 depicts a top view of a portion of an exemplary apparatus of the present invention.
Figure 11:
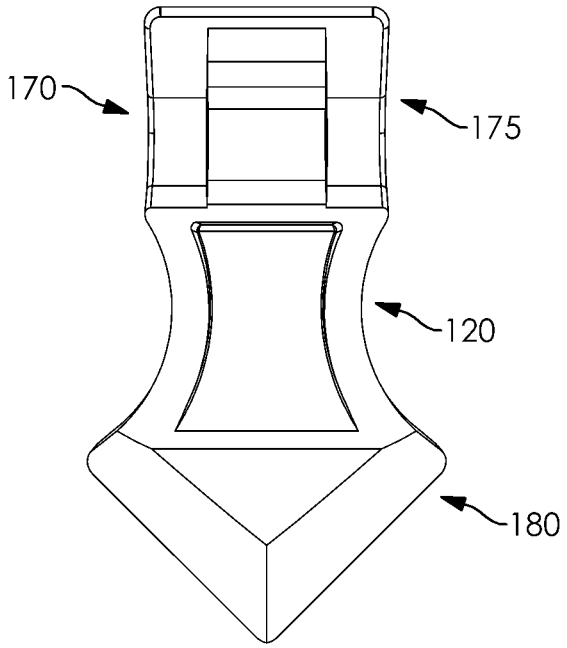
FIG. 11 depicts a bottom perspective view of a portion of an exemplary apparatus of the present invention.
Figure 12:
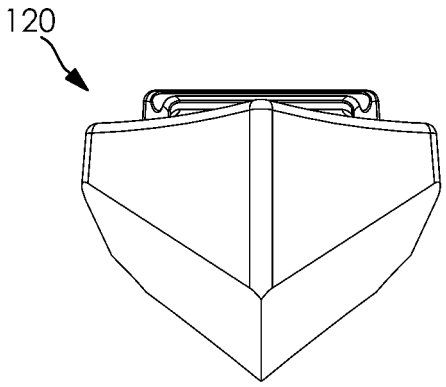
FIG. 12 depicts a front view of a portion of an exemplary apparatus of the present invention.
Figure 13:
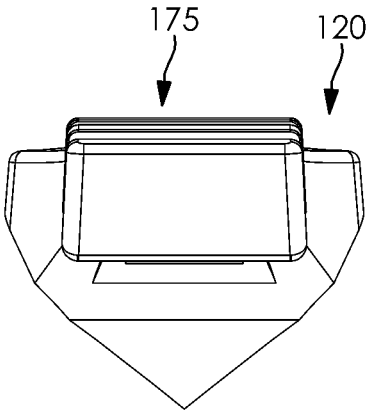
FIG. 13 depicts a rear view of a portion of an exemplary apparatus of the present invention.
Figure 14:
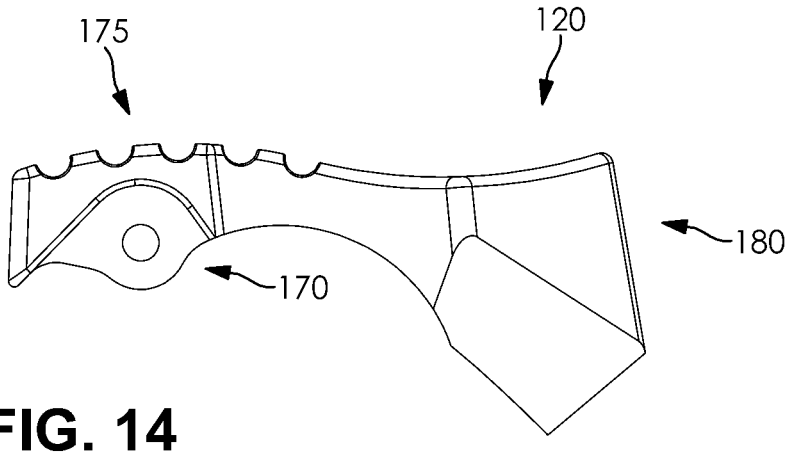
FIG. 14 depicts a side view of a portion of an exemplary apparatus of the present invention.

As illustrated in FIG. 3, body member 110 may include an aperture 155 comprising an opening that extends through a wall thickness of portion 130. Aperture 155 may for example serve as an access aperture (e.g., access port) for movable member 120 to puncture container 105 when container 105 is retained in assembly 100. For example, aperture 155 may be disposed at an upper or top portion of assembly 100 (e.g., at a portion substantially opposite to base member 115, for example, a center portion of portion 130). Also for example, one, two, three, or any other desired number of apertures 155 may be disposed at any suitable locations of body member 110. Aperture 155 may be of any desired shape. For example, aperture 155 may be larger (e.g., slightly larger or significantly larger) than dimensions of portions of movable member 120 so that the portions movable member 120 may pass through aperture 155 to puncture container 105. Also for example, aperture 155 may be rectangular, square, polygonal, circular, and/or any other suitable shape for forming an aperture for portions of movable member 120 to pass through while puncturing container 105. Body member 110 may also have an attachment portion 158 that may be located at or near aperture 155. Attachment portion 158 may attach to a portion of movable member 120. For example, attachment portion 158 may include one or more recesses, protrusions, and/or other attachment portions that may be received by one or more recesses, protrusions, and/or other attachment portions of movable member 120. For example as disclosed below, attachment portion 158 may movably (e.g., rotatably) attach movable member 120 to body member 110.

Body member 110 may also include one or more apertures 159 disposed at or near end portion 140 (e.g., or end portion 145). One or more apertures 159 may facilitate inserting and/or removing container 105 in cavity 125 by allowing a user to grip container 105 for controlled and easy insertion and/or removal of container 105 from cavity 125.

As illustrated in FIGS. 1 and 2, base member 115 may elevate end portion 140 relative to end portion 145. For example, base member 115 may be fixedly or movably attached to end portion 140 (e.g., or end portion 145) to elevate one of end portion 140 or end portion 145 relative to the other of end portion 140 or end portion 145. For example, end portion 140 that may be open may be elevated by base member 115 relative to end portion 145 that may be closed and/or that may include protrusion 150. For example, base member 115 may position body member 110 at an elevation angle 160 (e.g., an angle formed between a substantially horizontal axis such as that of a flat surface and the longitudinal axis of body member 110). Elevation angle 160 may be any suitable angle for elevating body member 110 (e.g., for holding container 105 during puncturing by movable member 120) such as, for example, between about one degree and about 10 degrees, between about 5 degrees and about 15 degrees (e.g., about 13 degrees), between about 10 degrees and about 20 degrees, between about 10 degrees and about 30 degrees, up to about 45 degrees, and/or any other desired elevation angle. Also for example, base member 115 may be movable to vary elevation angle 160. For example, base member 115 may be attached to end portion 140 or end portion 145 via an attachment portion 165 that may be movable or fixed. Attachment portion 165 may be, for example, a movable joint such as a rotatable joint (e.g., a hinge that may rotatably couple base member 115 to body member 110). Also for example, attachment portion 165 may be a removable attachment portion that removably attaches base member 115 to body member 110 (e.g., base member 115 may be removable from body member 110). For example, base member 115 may be configured to be stored within cavity 125 when base member 115 is removed (e.g., base member 115 may be small enough to fit into cavity 125 or may be folded and/or reduced in size to fit into cavity 125, for example for convenient storage).

FIGS. 5-8 illustrate another exemplary embodiment of the exemplary disclosed assembly. Assembly 200 may include a body member 210 and a base member 215 that may be similar to base member 115. Body member 210 may have a cavity 225 that may be formed by a cylindrical portion 230 and one or more wedge portions 235 (e.g., exemplary embodiments of the exemplary wedge portions disclosed for example above). Base member 215 may elevate one end portion (e.g., end portion 240) relative to another end portion (e.g., end portion 245) for example at an elevation angle 260. Body member 210 may include an aperture 255 through which an exemplary movable member of assembly 200 may selectively pass through.

FIGS. 9-14 illustrate for example an exemplary embodiment of the exemplary disclosed movable member (e.g., movable member 120). Movable member 120 may be movably attachable to body member 110. Movable member 120 may include an attachment portion 170, an actuating portion 175, and a puncturing portion 180. Attachment portion 170 may have one or more recesses, protrusions, and/or other attachment portions that may be received by one or more recesses, protrusions, and/or other attachment portions of attachment portion 158 of body member 110. For example, attachment portion 170 of movable member 120 may have protrusions that are received in recesses of attachment portion 158 of body member 110 so that movable member 120 may be movably (e.g., rotatably) attached to body member 110. For example, movable member 120 may be a rotatable lever disposed on body member 110 so that movable member 120 rotates about an axis formed by a movable (e.g., rotatable or hinged) attachment of attachment portion 170 to attachment portion 158. For example, movable member may be selectively moved by a user between a puncturing position in which puncturing portion 180 passes into and/or through aperture 155 and a non-puncturing in which puncturing portion 180 does not extend through aperture 155 (e.g., movable member 120 may be disposed substantially parallel to an external surface of body member 110).

Attachment portion 170 may for example be disposed at any desired portion (e.g., an end portion or a central portion) of movable member 120. Actuating portion 175 may be disposed for example at a first end portion of movable member 120 and puncturing portion 180 may be disposed at a second end portion of movable member 120 (or for example, actuating portion 175 may be disposed at or near puncturing portion 180). A user may for example actuate (e.g., push or otherwise urge) actuating portion 175 and/or puncturing portion 180, which may cause movable member 120 to move (e.g., rotate) about attachment portion 170 so that puncturing portion 180 moves through aperture 155 when a user actuates (e.g., pushes or otherwise urges) actuating portion 175 and/or punctuating portion 180. Actuating portion 175 and/or puncturing portion 180 may for example have protrusions and/or raised portions that may make it easier for a user to urge actuating portion 175 and/or puncturing portion 180 (e.g., without a user's finger slipping off of actuating portion 175 and/or puncturing portion 180).

Puncturing portion 180 may include protrusions on a surface facing aperture 155 (e.g., and facing container 105 when container 105 is placed within cavity 125). For example, puncturing portion 180 may include pointed or relatively sharp protrusions in any desired configuration. For example, the protrusions of puncturing portion 180 may form a substantially triangularly-shaped point that may puncture container 105 to form a substantially triangularly-shaped aperture in container 105. Also for example, the protrusions of puncturing portion 180 may form a substantially spherical-shaped point that may puncture container 105 to form a substantially spherical-shaped aperture in container 105. Protrusions of puncturing portion 180 may also be any other suitable shape such as, for example, square-shaped, rectangular-shaped, crescent-shaped, polygonal-shaped, and/or any other desired shape for creating a correspondingly-shaped aperture in container 105. Also for example, puncturing portion 180 may be configured with a substantially spherical point that may be threaded and/or ridged (e.g., similar to a drill bit) to facilitate puncturing containers 105 having relatively stronger or thicker container walls. Also for example, puncturing portion 180 may be configured to retain a power tool (e.g., or other suitable cutting device) for use in driving puncturing portion 180 through a wall of container 105.

Attachment portion 170 of movable member 120 and/or attachment portion 158 of body member 110 may also for example include an urging member 185 (e.g., any suitable spring such as a spring having coils, an elastic member or elastic band, a cable, a wire, and/or any suitable member formed from materials having elastic or resilient properties and/or capable of being stretched and unstretched and/or compressed and uncompressed). Urging member 185 may for example urge movable member 120 from a puncturing position in which puncturing portion 180 passes into and/or through aperture 155 toward a non-puncturing position in which puncturing portion 180 does not extend through aperture 155 when for example a user is not urging actuating portion 175 and/or puncturing portion 180. For example, a user may apply a force sufficient to overcome an urging force of urging member 185 in order to move movable member 120 to the puncturing position.

Also for example, attachment portion 170 of movable member 120 may be removably attachable to attachment portion 158 of body member 110 so that movable member 120 may be removably attachable to body member 110. For example, movable member 120 may be configured to be stored within cavity 125 when movable member 120 is removed (e.g., movable member 120 may be small enough to fit into cavity 125 or may be folded and/or reduced in size to fit into cavity 125, for example for convenient storage).

Alternatively for example, movable member 120 may be integrally formed (e.g., or attached) with body member 110 so that attachment portion 170 and attachment portion 158 comprise a flexible cantilever member that extends from body member 110 to cover a portion of aperture 155. Actuating portion 175 may be formed on a surface of movable member 120 facing a user and puncturing portion 180 may be formed on a surface of movable member 120 facing cavity 125. For example, when a user actuates actuating portion 175 and/or puncturing portion 180, movable member 120 may be urged (e.g., be cantilevered) into through aperture 155 and into cavity 125 in order to puncture container 105.

For example, the exemplary disclosed apparatus may include body member 110 that may be substantially cylinder-shaped and that may rest at an angle relative to a flat surface on which assembly 100 is placed. For example, assembly 100 may be used as a "Shotgun Shell" (e.g., or known as "Shotgun Shell") to retain container 105 (e.g., a beer can) within cavity 125 (e.g., of a cylinder) while puncturing an aperture in container 105 to shotgun the beer. For example, the Shotgun Shell may include movable member 120 (e.g., a lever) configured to poke a hole into a beer can that is retained within the Shotgun Shell cylinder. Also for example, the hole created in container 105 (e.g., the beer can) may be optimized for an effective shotgun of the beverage.

In at least some exemplary embodiments, body member 110 may have a length of between about 3 inches and about 10 inches, between about 4 inches and about 6 inches (e.g., about 4.5 inches), or any other desired length. In at least some exemplary embodiments, body member 110 may have a diameter of between about 2 inches and about 6 inches, between about 2 inches and about 4 inches (e.g., about 2.6 inches), or any other desired diameter. In at least some exemplary embodiments, puncturing portion 180 of movable member 120 may be a triangularly-shaped portion (e.g., or any other desired shape) that has dimensions of up to two inches on each side (e.g., about 0.5 inches such as about 0.5 inches high) or any other desired dimensions. Also for example, puncturing portion 180 may be a triangularly-shaped portion that may be located between about 0.25 inches and about 2 inches (e.g., about 0.3 inches) from an end of end portion 140.

In at least some exemplary embodiments, assembly 100 may provide for one-handed motion for a user to easily poke a hole inside a beer can at a party to shotgun the beer. For example, body member 110 of assembly 100 may have a cylinder-like shape to provide support for a beer can.

In at least some exemplary embodiments, an exterior surface of assembly 100 may be designed and painted. For example, if one or more users is at a party watching their favorite football team, they may use assembly 100 (e.g., a Shotgun Shell) with their friends to shotgun a beer while assembly 100 is decorated to display markings of their favorite team. For example, assembly 100 (e.g., Shotgun Shell) may be a one-handed device that may be painted or designed to indicate the customer's favorite sports team, college, or organization.

In at least some exemplary embodiments, body member 110 may have a substantially cylindrical structure having movable member 120 (e.g., a lever) configured to open an aperture using a puncturing action against container 105 that may be removably inserted within the cylindrical structure when sufficient puncturing force is applied to movable member 120 (e.g., a lever). For example, container 105 may be a can retaining liquid. For example, the liquid may be beer. For example, the aperture opened in container 105 by use of assembly 100 may be sufficiently sized to permit rapid egress of liquid such as beer through the aperture formed in container 105 (e.g., a beer can). For example, a user may operate movable member 120 (e.g., the lever) with a puncturing action to open an aperture in container 105 to optimally (e.g. rapidly) consume the beer. For example, container 105 may be retained with the punctured aperture elevated (e.g., elevated and facing upward) to prevent spillage. Assembly 100 may for example provide relatively rapid and safe beverage consumption based on puncturing container 105 retained within a cylindrically shaped cavity (e.g., cavity 125) of assembly 100.

The exemplary disclosed apparatus and method may be used in any suitable application for puncturing a container. For example, the exemplary disclosed apparatus and method may be used in any application involving opening containers to increase and/or enhance a flow rate of material from the container. For example, the exemplary disclosed apparatus and method may be used in any application involving opening a container with one hand of a user while the other hand of the user is free to be used for another purpose. For example, the exemplary disclosed apparatus and method may be used in any application allowing a user to shotgun a beverage such as a beer.

For example, the exemplary disclosed apparatus may include a body member (e.g., body member 110 and/or beer shotgun member) including a beverage-container-receiving cavity (e.g., beer-can receiving cavity and/or cavity 125), an aperture (e.g., aperture 155) disposed in the body member, and a movable member (e.g., movable member 120) disposed on the body member, the movable member having a beverage-container-puncturing portion (e.g., beer-can-puncturing portion and/or puncturing portion 180). The beverage-container-puncturing portion may be selectively movable into the beverage-container-receiving cavity via the aperture. The exemplary disclosed apparatus may also include a base member (e.g., base member 115) attached to the body member, the base member elevating a first end portion (e.g., end portion 140) of the body member relative to a second end portion (e.g., end portion 145) of the body member. The base member may be for example rotatably attached and/or removably attachable to the body member. The base member may be for example configured to fit within the beverage-container-receiving cavity. The movable member may be for example removably attachable to the body member and/or configured to fit within the beverage-container-receiving cavity. The beverage-container-receiving cavity may be for example a beer-can-receiving cavity. The movable member may be for example a rotatable lever or a cantilever. The exemplary disclosed apparatus may include an urging member (e.g., urging member 185) configured to urge the movable member out of the aperture. The body member may be for example cylinder-shaped or wedge-shaped. The movable member may be for example a lever that may be attached to the body member by a hinge. The puncturing portion (e.g., beer-can-puncturing portion and/or puncturing portion 180) may for example include a triangular protrusion.

An exemplary operation of the exemplary disclosed apparatus and method will now be described. Assembly 100 may be provided for example on a flat or substantially flat surface (e.g., a floor, ground, a countertop, a table, or any other desired surface). Base member 115 may provide for an end portion of body member 110 to be elevated relative to another end portion of body member 110 (e.g., end portion 140 may be elevated relative to end portion 145). A user may for example adjust base member 115 (e.g., adjust attachment portion 165 that may be a movable attachment portion such as a hinge) to provide a desired elevation angle 160.

The user may insert container 105 into cavity 125. For example, as container 105 is inserted, a user may grip container 105 so that the user's fingers are received by one or more apertures 159 to facilitate insertion. For example, container 105 may be inserted into cavity 125 so that an opening device (e.g., tab) of container 105 is inserted first into cavity 125. For example, a tab of container 105 (e.g., a top) may be disposed at end portion 145, which may be lower than elevated end portion 140. For example, container 105 may be inserted upside down into cavity 125, with a bottom of container 105 at elevated end portion 140. It is also contemplated that container 105 may be inserted with a bottom first so that a bottom of container 105 is at end portion 145.

The user may then actuate actuating portion 175 and/or puncturing portion 180 to move (e.g., rotate, cantilever inward, and/or cause any other exemplary movement) movable member 120 so that puncturing portion 180 moves from the non-puncturing position and through aperture 155 of body member 110 to the puncturing position to puncture a wall of container 105. For example, movable member 120 may cause a puncturing action against container 105 when, e.g., a user applies a sufficient puncturing force against actuating portion 175 and/or puncturing portion 180 to actuate movable member 120. For example, the user may apply a large enough force to for example overcome an urging force applied by urging member 185 and to puncture a wall of container 105 with puncturing portion 180. For example, the user may apply a quick and/or forceful actuation to movable member 120 to force puncturing portion 180 through a wall of container 105. Puncturing portion 180 may provide a cleanly punctured aperture in container 105 (e.g., containing substantially no jagged and/or sharp edges). Based on an orientation of container 105, puncturing portion 180 may provide an aperture at a bottom portion of container 105 disposed at end portion 140, which may provide a substantially safe drinking hole in container 105. The aperture formed in container 105 by puncturing portion 180 may be at a top side of container 105 based on the location of container 105 relative to aperture 155 and puncturing portion 180.

The user may then remove container 105 from cavity 125. The user may for example place his or her fingers at one or more apertures 159 to grip container 105 to facilitate removing container 105 from cavity 125 of body member 110.

The user may initially raise container 105 with the punctured aperture facing upward (e.g., with container 105 substantially horizontal) and place their mouth on the aperture (e.g., drinking hole punctured by puncturing portion 180). The user may then rotate container 105 so that it is right-side up (e.g., opening device at an upper position), open the opening device (e.g., tab) of container 105, and consume the contents of container 105. Because container 105 includes two openings (e.g., the punctured aperture provided by puncturing portion 180 and the opening provided by opening the opening device of container 105 such as a tab), a pressure differential between the space inside container 105 and outside container 105 may be reduced so that the contents (e.g., fluid) of container 105 escapes rapidly (e.g., and the user can drink the contents rapidly).

The exemplary disclosed method may for example include providing an assembly (e.g., assembly 100) having a cavity (e.g., cavity 125) and a movable member (e.g., movable member 120) that is disposed on the assembly, removably disposing a beverage container (e.g., container 105) in the cavity, moving the movable member through an aperture of the assembly and into the cavity, and puncturing the beverage container with the movable member. The beverage container may be for example a beer can. The exemplary disclosed method may further include opening an opening device of the beer can.

For example in the case of a party atmosphere when container 105 contains for example alcohol such as beer, a user may desire to complete the exemplary method as quickly as possible to contribute to said party atmosphere. The user may insert container 105 into cavity 125, puncture container 105 using movable assembly 120, remove container 105, and shotgun liquid such as beer in container 105 as quickly as possible (e.g., in a few seconds). For example, a user may be cheered on by other users and/or derided by other users depending on how quickly the beer of container 105 is consumed and/or whether any of the beer of container 105 spills onto the ground.

The exemplary disclosed method and apparatus may provide an effective technique for opening containers to enhance a rate of flow from the container. For example, the exemplary disclosed method and apparatus may reduce the effort required to provide an opening in a container to shotgun a beverage such as a beer by providing a movable member (e.g., lever) operable with one hand to puncture an aperture in the container while the container is retained by the apparatus. Also for example, the exemplary disclosed method and apparatus may provide a relatively large opening in a relatively short period of time based on enhancing a force applied to a container by the puncturing action, due to increased leverage as a function of a lever length. Further for example, the exemplary disclosed method and apparatus may provide a convenient technique to shotgun a beverage such as a beer based on the apparatus retaining a container to free the user's other hand. Also for example, the exemplary disclosed apparatus and method may provide a relatively safe opening in a container based on the apparatus being configured to create apertures using a movable member (e.g., lever) operable with a consistent and/or predictable puncturing action.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

Many suitable methods and corresponding materials to make each of the individual parts of embodiment apparatus are known in the art. According to an embodiment of the present invention, one or more of the parts may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as described herein-above may be used. Many suitable materials are known and available and can be selected and mixed depending on desired strength and flexibility, preferred manufacturing method and particular use, as will be apparent to a person of ordinary skill in the art.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A beverage puncturing apparatus, comprising:

a body member including a beverage-container-receiving cavity, wherein the body member includes a first end portion that is open to the beverage-container-receiving cavity, a second end portion that is partially open, and a wall portion disposed between the first end portion and the second end portion and forming the beverage-container-receiving cavity;

an aperture that is spaced a first distance from the first end portion that is open and a second distance from the second end portion, the aperture extending through a thickness of the wall portion; and a movable member disposed on the body member via an attachment portion, the movable member having a beverage-container-puncturing portion;

wherein the beverage-container-puncturing portion is selectively movable through the aperture to move into the beverage-container-receiving cavity;

wherein the body member including the wall portion is cylinder-shaped or wedge-shaped;

wherein the first distance is less than the second distance; and wherein the beverage-container-puncturing portion is a solid, fluid-blocking portion; and, a protrusion concentric with and smaller in diameter than an inner surface of the first end portion is disposed along a surface of the beverage container receiving cavity at the partially open second end portion.

2. The apparatus of claim 1, further comprising a base member formed of a solid material and directly attached to the body member via a base attachment portion at the first end portion, the base member elevating the first end portion of the body member above a surface relative to the second end portion that rests on the surface.

3. The apparatus of claim 2, wherein the movable member is removably attachable to the body member via the attachment portion, and the attachment portion of the movable member at the first end portion is disposed in a same transverse plane of the body member as the base attachment portion of the base member at the first end portion.

4. The apparatus of claim 1, wherein:

the movable member is a rotatable lever or a cantilever that is attached via the attachment portion comprising two protrusion that are disposed on the wall portion between the first end portion and the aperture;

the beverage-container-puncturing portion is thicker than a portion of the movable member attached to the attachment portion.

5. The apparatus of claim 1, wherein:

the movable member is rotatably attached to the body member the beverage-container-puncturing portion includes a triangular pointed portion disposed at a first surface facing the beverage-container-receiving cavity;

the beverage-container-puncturing portion includes a plurality of protrusions on a second surface extending in a direction away from the beverage-container-receiving cavity; and the aperture is a substantially triangular shaped aperture that is sized larger than the triangular pointed portion so that a gap is formed around the triangular pointed portion, between the triangular pointed portion and the substantially triangular shaped aperture, when the triangular pointed portion is disposed in the substantially triangular shaped.

6. The apparatus of claim 1, wherein a plurality of additional apertures extend through a thickness of the wall portion at the first end portion, a portion of the wall portion separating the aperture from the plurality of additional apertures, each of the plurality of additional apertures sized to receive a thumb or a finger of a user of the apparatus.

7. The apparatus of claim 1, wherein:

the wall portion is a hollow cylinder forming the beverage-container-receiving cavity; and the wall portion is formed from structural metal.

8. The apparatus of claim 1, wherein: the apparatus is for receiving a beverage container having a cylindrical side wall disposed between a top portion and a bottom portion of the beverage container, the beverage container being received through the first end portion that is open;

the wall portion is configured to be adjacent to the cylindrical side wall of the beverage container when the beverage container is received in the apparatus;

the beverage-container-puncturing portion is configured to punch through the cylindrical side wall of the beverage container when the beverage container is received in the apparatus and the beverage-container-puncturing portion moves through the aperture and into the beverage-container-receiving cavity; and the beverage-container-puncturing portion includes a substantially spherical point.

9. The apparatus of claim 1, wherein:

a portion of the wall portion of the body member separates the aperture from the first end portion; and the attachment portion is disposed on the portion of the wall portion.

10. The apparatus of claim 1, wherein:

the aperture is completely bounded by the wall portion of the body member, with a first portion of the wall portion separating the aperture from the first end portion, and a second portion of the wall portion separating the aperture from the second end portion.

11. The apparatus of claim 1, wherein the aperture is a closed shape that is completely bounded by the wall portion and that is larger than the beverage-container-puncturing portion, so that when the beverage-container-puncturing portion selectively moves through the aperture into the beverage-container-receiving cavity, a gap is formed completely around the beverage-container-puncturing portion, the gap separating the beverage-container-puncturing portion from the wall portion.

12. A method, comprising: providing an assembly having a body member that forms a cavity and that includes a first end portion that is open to the cavity, a second end portion that is partially open to the cavity, and a wall portion disposed between the first end portion and the second end portion:

providing a movable member that is disposed on the assembly;

providing a beverage container including a cylindrical side wall disposed between a flat top portion and a flat bottom portion of the beverage container, at least one of the flat top portion and the flat bottom portion including an opening device;

removably disposing the beverage container within the cavity;

moving the movable member through an aperture of the wall portion into the cavity, the aperture extending through a thickness of the wall portion;

puncturing the cylindrical side wall with the movable member when the beverage container is disposed within the cavity and the movable member is moved through the aperture into the cavity;

removing the beverage container from the cavity after puncturing the cylindrical side wall; and opening the opening device of the beverage container after puncturing the cylindrical side wall and while the beverage container is removed from the cavity;

wherein the aperture is spaced a first distance from the first end portion and a second distance from the second end portion, the first distance being less than the second distance, and a protrusion concentric with and smaller in diameter than an inner surface of the first end portion is disposed along a surface of the beverage container receiving cavity at the partially open second end portion.

13. The method of claim 12, wherein: the beverage container is a beer can and the opening device is a beer can tab.

14. The method of claim 12, wherein:

the wall portion surrounds the beverage container when the beverage container is disposed within the cavity; and the wall portion has a continuous circular shape, and the assembly including the wall portion is a hollow cylinder forming the cavity sized to receive the beverage container that is an aluminum beer can.

15. A beverage puncturing apparatus, comprising:

a body member including a beverage-container-receiving cavity, wherein the body member includes a first end portion that is open to the beverage-container-receiving cavity, a second end portion that is partially open, and a wall portion disposed between the first end portion and the second end portion and forming the beverage-container-receiving cavity;

an aperture that is spaced a first distance from the first end portion that is open and a second distance from the second end portion, the aperture extending through a thickness of the wall portion; and a movable member disposed on the body member via an attachment portion, the movable member having a beverage-container-puncturing portion;

wherein the beverage-container-puncturing portion is selectively movable through the aperture to move into the beverage-container-receiving cavity;

wherein the body member including the wall portion is cylinder-shaped or wedge-shaped;

wherein the first distance is less than the second distance;

wherein a portion of the wall portion of the body member separates the aperture from the first end portion; and wherein a plurality of additional apertures extend through the thickness of the wall portion at the first end portion, a portion of the wall portion separating the aperture from the plurality of additional apertures, each of the plurality of additional apertures sized to receive a thumb or a finger of a user of the apparatus, and a protrusion concentric with and smaller in diameter than an inner surface of the first end portion is disposed along a surface of the beverage container receiving cavity at the partially open second end portion.

16. The apparatus of claim 15, wherein the movable member is a rotatable lever or a cantilever that is attached to a portion of the wall portion disposed between the first end portion and the aperture, the portion of the wall portion separating the aperture from the first end portion.

17. The apparatus of claim 16, further comprising a base member that is rotatably attached to the body member at the first end portion, the base member elevating the first end portion of the body member relative to the second end portion of the body member at an elevation angle, the base member being attached to the body member via a second attachment portion disposed in a same transverse plane of the body member as the attachment portion of the movable member;

wherein the attachment portion and the second attachment portion are disposed on opposite sides of the first end portion;

wherein the attachment portion and the second attachment portion are disposed at an end of the first end portion;

wherein the base member is selectively movable past the transverse plane so that the base member selectively extends past the end of the first end portion;

wherein the plurality of additional apertures are each elongated slots configured to receive the thumb or the finger of the user;

wherein the elevation angle varies between 10 degrees and 30 degrees based on rotation of the base member about the second attachment portion.

18. The apparatus of claim 15, wherein the second end portion includes a member having a second end portion aperture, the second end portion aperture shaped as a half-circle that opens half of the member to the beverage-container-receiving cavity.

* * * * *